United States Patent [19]

Shibayama et al.

[11] 4,039,415

[45] Aug. 2, 1977

[54] PROCESS FOR PREPARING INSULATION WIRE

[75] Inventors: Kyoichi Shibayama; Fumihiko Sato; Takashi Takahama, all of Amagasaki, Japan

[73] Assignee: Mitsubishi Denki Kabushiki Kaisha, Tokyo, Japan

[21] Appl. No.: 584,115

[22] Filed: June 5, 1975

[30] Foreign Application Priority Data

June 5, 1974 Japan ..... 49-64307
Oct. 23, 1974 Japan ..... 49-122709

[51] Int. Cl.[2] ..... C25D 13/06; C25D 13/16
[52] U.S. Cl. ..... 204/181
[58] Field of Search ..... 204/181

[56] References Cited

U.S. PATENT DOCUMENTS 3,331,762 7/1967 Jackson ..... 204/181
3,640,810 2/1972 Plasyuski et al. ..... 204/181
3,891,526 6/1975 Masuda et al. ..... 204/181

*Primary Examiner*—Howard S. Williams
*Attorney, Agent, or Firm*—Oblon, Fisher, Spivak, McClelland & Maier

[57] ABSTRACT

A process for preparing an insulation wire wherein the wire is dipped into a water dispersion synthetic resin and a resin layer is formed thereon by electrodeposition, and then the wire is immediately treated in a hot water or steam bath to co-melt colloidal particles of the resin in the resin layer, whereby the water in this resin layer is forced to move to the surface so that the water content may be kept at a minimum. The water on the resin layer is removed by blowing air thereacross and a vapor of a film-forming agent is then applied to the wire at high wire running speeds before the resin layer is cured in a heating furnace.

5 Claims, 3 Drawing Figures

PROCESS FOR PREPARING INSULATION WIRE

BACKGROUND OF THE INVENTION

1. Field of the Invention

The present invention relates generally to a process for electrophoretically preparing an insulation wire.

2. Description of the Prior Art

Processes have heretofore been developed for preparing insulation wires by electrodeposition so that the insulation wires have been commercialized as magnet wires. Two types of varnishes have been employed for electrodeposition coating, namely a water soluble type varnish and a water dispersion type varnish. The water dispersion type varnish has been considered to be superior to the water soluble type from the viewpoint of its electrodeposition rate and the thickness of the film as a varnish for insulation.

In the preparation of electric wires, the productivity and economy are dependent upon the wire running speed. In the conventional dip coating method, a high wire running speed, such as, for example, higher than several hundreds m/min., has been attained. Accordingly, a high wire running speed, such as higher than 50 m/min., has been required for an electrodeposition coating method.

It has been well-known to apply a film-forming auxiliary agent (polar organic solvent and polyols) after electrodeposition takes place in an electrodeposition coating method using a water dispersion varnish. In the case of the wire running at a speed of less than 50 m/min., there is to is no washing with water and applying the film-forming auxiliary agent after the electrodeposition. However, in the case of the wire running at speeds higher than 50 m/min., it has been found to increase the amount of a varnish drawn out from an electrodeposition bath, except the electrodeposited resin. Accordingly, the film-forming auxiliary agent in the post-treatment bath has been contaminated.

FIG. 1 is a schematic view showing the steps of a conventional process for preparing an insulation wire by an electrodeposition. In FIG. 1, a wire 1 is shown running along a line in the direction indicated by an arrow, being drawn through an electrodeposition bath 2, a washing shower 3, a post-treatment bath 4, a roller wiper 5, an air wiper 6, a semi-curing furnace 7 and a final curing furnace 8. The running wire 1 is passed through the electrodeposition bath 2, wherein a water dispersion synthetic resin is electrodeposited thereon and the excess of such varnish drawn out therewith is washed off by the washing shower 3. The wire is then passed through a film-forming auxiliary agent in the post-treatment bath 4 and the excess film-forming auxiliary agent thereon is removed thereafter by the roller wiper 5 and the air wiper 6. The resin layer on the wire is then heated by passing the wire through the semicuring furnace 7 and the final curing furnace 8 to cure it.

Thus, in the electrodeposition coating method using the water dispersion synthetic resin varnish, it has been necessary to apply an organic solvent as the film-forming auxiliary agent after the electrodeposition. However, the disadvantages of contamination of the organic solvent by the varnish drawn off with the wire and an increase of the amount of the organic solvent and the like have been found to be dependent upon an increase of the wire running speed. These troubles have not been found to occur in the case of a conventional low speed operation.

Accordingly, it has been necessary to search for an improvement of the process for preparing an insulation wire by an electrodeposition. In order to prevent contamination with the varnish in the post-treatment bath, removal of the varnish by an air wiper and a roller wiper, as indicated, has been considered. However, the former operation has not been suitable for a mass production apparatus wherein many wires are run, because of the swing of the wire by air pressure, and the latter operation has not been satisfactory because the electrodeposited resin layer is soft and is deformed even by a slight pressure, as the water content of the resin layer is about 50 percent by weight. In order to prevent excess varnish on the wire, it has been considered to wash the wire with water after the electrodeposition. In the process for preparing an insulation wire by an electrodeposition, the resin layer has thus been washed with water after the electrodeposition at high wire running speed. However, in the case of high wire running speed, the water is carried into the post-treatment bath so as to deteriorate the effect of the film-forming auxiliary agent within a short time. Accordingly, it is necessary to frequently provide a fresh supply of the film forming auxiliary agent, and the resultant economical loss is remarkably high.

It has also been proposed to combine an electrodeposition coating process with a dip coating process so as to attain the demands. However, in the proposed process for overcoating a varnish immediately after the electrodeposition, a large amount of water is incorporated in the electrodeposited resin layer. Accordingly, the electrodeposited resin layer is cracked or spotted to thus provide an insulation wire having an uneven coating layer, and it has been hard to obtain an insulation wire having good appearance and good characteristics.

More specifically, when a resin is deposited on a wire by an electrodeposition, the film is not solidified. Accordingly, the electrodeposited resin layer is damaged when overcoating immediately after the electrodeposition and the overcoated layer is significantly contaminated with varnish drawn out from the bath 2. Further, a wiper die for controlling the thickness of the overcoat layer cannot be used, whereby different thicknesses and uneveneness of the layer are disadvantageously caused by the wire running at speeds higher than 10 m/min. The method of heating the electrodeposited resin layer to dry it before the overcoating step, so as to overcome these disadvantages, has been difficult to practically apply because a resin layer having a thickness required for insulation that is greater than $10\mu$ is significantly cracked by drying it and a desirable film is thus not obtained by overcoating.

SUMMARY OF THE INVENTION

Accordingly, it is an object of the present invention to overcome the above-mentioned disadvantages of the heretofore known methods and to provide an improved electrodeposition process for preparing an insulation wire having uniform coated film even the wire is run at high speeds.

This object and others as well have been attained according to the present invention by forming an electrodeposited resin layer on a substrate and then passing the substrate having the electrodeposited resin layer through a hot water or a steam bath, whereby an operation with the wire running at speeds of higher than 40 m/min. is successfully attained. Thus in this invention, a resin coated substrate is dipped into a hot water bath after an electrodeposition so as to immediately remove water from the electrodeposited resin layer and the coagulation and comelt of the electrodeposited colloidal particles are thereby promoted to form a continuous film, that is, a film having no cracking, whereby the application of a roller wiper and an air wiper can be made. That is, a wire is passed through a water dispersion type varnish and the wire, having the electrodeposited resin layer containing colloidal particles and a large amount of water which is coated by an electrodeposition, is dipped into a hot water to comelt the colloidal particles, whereby water in the layer is forced to move on the surface by capillarity so that the water content of the layer is remarkably decreased to cause the layer to become hard and the resulting film is thus not deformed, even by directly contacting it with a roller wiper.

Another advantage of the present invention is the capability of applying a vapor of a film-forming auxiliary agent with a horizontal view running at high speeds. It has been well known that the solubilizing ability of the film-forming auxiliary agent is increased depending upon the increase of temperature. In high speed film formation, a vapor treatment is indispensible. However, when the electrodeposited resin layer having varnish drawn out therewith is exposed to the vapor of the film-forming auxiliary agent, the colloidal particles in the varnish so drawn out are immediately and partially coagulated to form a non-uniform film having knots therein. However, the above-mentioned disadvantageous phenomena can be improved by removing the varnish by a wiper and a continuous film can be formed at high speed by combining the steam treating method, as indicated.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference numerals designate like or corresponding parts of the several embodiments and in which.

DESCRIPTION OF THE PREFERRED EMBODIMENTS

Figure 1:
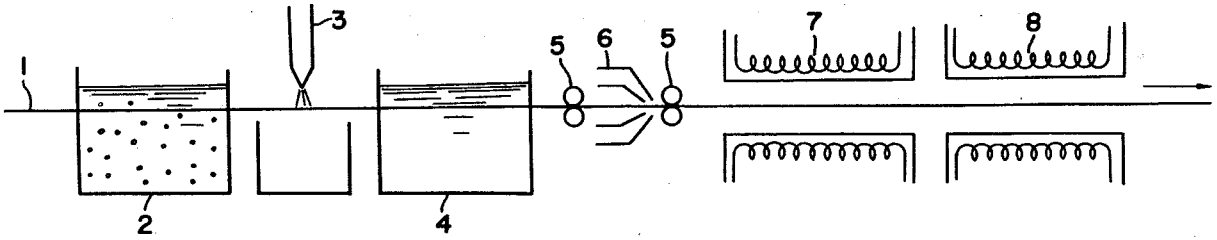
FIG. 1 is a schematic view of a system for the conventional process, as already described.
Figure 2:
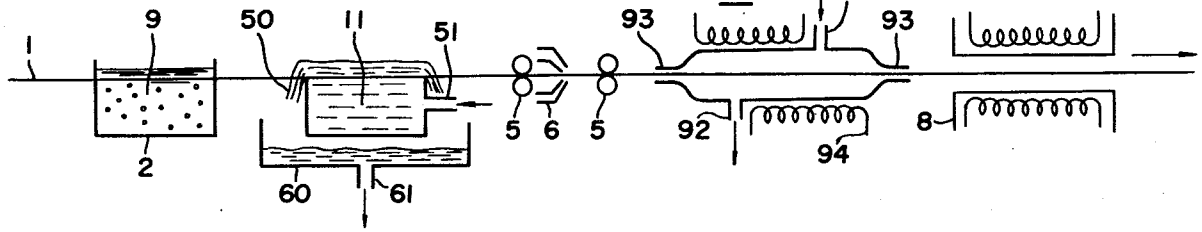
FIG. 2 is a schematic view of one embodiment of a system for the present invention.

Referring now further to the drawings, FIG. 2 is a schematic view of a horizontal type apparatus for preparing an insulation wire by an electrodeposition, wherein a wire 1, which is running, is passed through a water dispersion varnish 9 in an electrodeposition bath 2, and the wire carrying an excess of varnish is drawn out and is passed to a water washing bath 50. Hot water 11 is passed through a water inlet 51 into the water washing bath 50 and the hot water 11 which overflows therefrom is discharged from an outlet 61 of an outer vessel 60 to a recycling passage. The varnish drawn out with the wire is washed off by the hot water 11 and simultaneously the electrodeposited resin layer is converted to a continuous film. The water on the continuous film is blown off by air blowing from the nozzle of the air wiper 6. Swinging of the wire caused by the air wiper 6 is prevented by a roller wiper 5 disposed in forward relation thereto. The coated wire 1 is then passed into an auxiliary vapor treating apparatus 90 to apply the film-forming auxiliary agent and thereafter is heated in a curing furnace 8 to cure the coated film. The vapor of the film-forming auxiliary agent is fed from an inlet 91 of the vapor treating apparatus 90 and is discharged from an outlet 92 thereof, but it is prevented from leaking from the inlet and outlet 93 of the wire 1 by suitable sealing means.

The temperature of the film-forming auxiliary agent in the auxiliary vapor treating apparatus 90 is kept by heating with a heater 94 disposed outside the apparatus 90. The reason for the application of the film-forming auxiliary agent is to give a smooth continuous film surface and to increase the luster of the film surface.

The film-forming auxiliary agents used are the hydrophilic organic solvents, such as, for example, a polar organic solvent, as for example, N-methyl-2-pyrrolidone, N,N-dimethylformamide, N,N-dimethylacetoamide and the like, and polyols and derivatives thereof, as for example, ethyleneglycol, ethyleneglycol monomethyl ether, ethyleneglycol monoethyl ether, ethyleneglycol monoacetate and the like.

The varnish can be any water dispersion varnish which can be electrodeposited. It is preferable, however, to use a varnish which forms an electrodeposited resin layer having a minimum film-forming temperature of less than 100° C.

In the embodiment of FIG. 2, the wire is passed through a water dispersion varnish to form a resin layer by an electrophoresis, and then it is passed through hot water to remove the water dispersion varnish drawn out on the resin layer and to promote the comelting of colloidal particles of the resin layer to decrease water content in the resin layer. Then the water on the resin layer is removed by the air wiper and the roller wiper and the wire is passed through the vapor of the film-forming auxiliary agent to apply the film-forming auxiliary agent to the resin layer, whereupon it is heated in a curing furnace to cure it, whereby an insulation wire, having uniform insulation film which has no cracking or knots, can be prepared in an economical operation.

Figure 3:
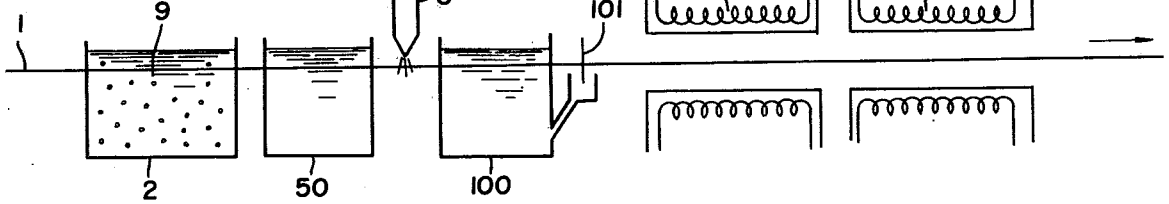
FIG. 3 is a schematic view of another embodiment of a system for carrying out the method of this invention.

In the embodiment illustrated in FIG. 3 the wire 1 having a resin layer which has a water content of 50–60% by weight is passed through the bath 50 for heating the wire with hot water at higher than 75° C, or with steam, whereby the water in the resin layer is moved out by the comelt of colloidal particles of the resin layer to decrease to about 20% by weight. Accordingly, a porous resin layer is formed, but the surface of the resin layer is converted to a film having such strength that it is not damaged by being contacted by a guide roller.

The resin layer is dried by blowing hot air thereon at about 150° C by a hot air wiper 6, which need not be precisely controlled at that temperature. The wire is passed through a dipping vessel 100 filled with an overcoating agent and is passed to a wiper die 101 for removing any excess of the overcoating agent. The overcoating agent removed by the wiper die 101 is recycled to the dipping vessel 100.

Incidentally, the wire 1 passed through the wiper die 101 is further passed through the curing furnaces 7 and 8 to cure the resin layer and the overcoated layer, which can be done in the conventional manner.

When a water soluble varnish or hydrophilic organic solvent varnish is used, it is possible to overcoat the wire immediately after the hot water or the steam treatment. However, when a hydrophobic organic solvent type varnish is used, it is preferable for preparing a desirable wire to dry it after the hot water or the steam treatment, from the viewpoint of affording long stability against the contamination with the varnish and the overcoated resin.

As stated above, it is possible to form a porous layer having no cracking and to increase the mechanical strength of the wire by applying the step of treating in a hot water or a steam bath for heating and dehydrating the electrodeposited layer. Accordingly, the overcoating agent is immersed into the resin layer so as to improve the adhesive property of the film and the substrate after curing it, and the wiper die 101 can be applied for preparing an insulation wire having a smooth surface which does not have the disadvantages of different thickness and pin holes.

The temperature of the hot water or the steam in the treating bath or tank 50 is higher than the film-forming temperature for the electrodeposited resin layer and is high enough to remove water formed by dehydration from the resin layer, and is usually higher than 75° C.

the invention will be further illustrated by certain examples, especially on the embodiment of FIG. 3.

EXAMPLE 1

A 20% water dispersion synthetic resin varnish prepared by polymerizing 45 parts by weight of styrene, 45 parts by weight of ethyl acrylate, 5 parts by weight of glycidyl methacrylate and 5 parts by weight of methacrylic acid was charged in an electrodeposition bath 2 having a length of 30 cm, and 6 volts of DC voltage was applied between an electrode having a length of 30 cm which was disposed in the bath and a bare copper wire 1 having a diameter of 0.5 mm which was run at a wire running speed of 40 m/min.. The wire 1 passed through the electrodeposition bath 2 was further passed through a hot water bath 50 having a length of 50 cm which was kept at 80° C. The wire was further passed through a vessel 100 containing water soluble polyester varnish 40% by weight of resin content, which was prepared by neutralizing a polyester, having terminal carboxylic groups comprising main components of polyethyleneterephthalate, glycerine and mellitic anhydride, with monoethanolamine. The thickness of the coated film was controlled by a wiper die 101 and the coated wire was passed through curing furnaces 7 and 8 for curing. An insulation wire having a thickness of 24μ and excellent appearance was obtained.

EXAMPLE 2

A 20% water dispersion synthetic resin varnish prepared by polymerizing 77 parts by weight of bisphenol type epoxy resin, 3 parts by weight of ethyleneglycol and 20 parts by weight of tetrahydrophthalic anhydride was charged in an electrodeposition bath 2, and 6 volts of DC voltage was applied between an electrode which was disposed in the bath and a bare copper wire 1 having a diameter of 0.5 mm which was run at a wire running speed of 40 m/min.. The wire 1 passed through the electrodeposition bath 2 was treated with a hot water at 85° C. The water soluble polyester resin varnish of Example 1 was coated and cured in accordance with the process of Example 1. An insulation wire having a thickness of 26μ and excellent appearance was obtained.

EXAMPLE 3

The water dispersion synthetic resin varnish of Example 1 was filled in the electrodeposition bath 2, and 6 volts of DC voltage was applied between the electrode and the bare copper wire 1 having a diameter of 0.5 mm at a wire running speed of 40 m/min.. The wire 1 passed through the electrodeposition bath 2 was treated with a hot water at 80° C, and then the coated wire was dried by a hot air blower 6 and the dried wire was coated with a solvent type enamel resin of ester-imide having a viscosity of 15 cps at 40° C by passing through a die, and the coated wire was cured. An insulation wire having a thickness of 25μ and excellent appearance was obtained.

EXAMPLE 4

The wire 1 coated by the electrodeposition, in accordance with the conditions of Example 1, was passed through a tank 50 having a length of 30 cm to which steam at about 100° C was fed from a steamer, and then the wire was further treated in accordance with the condition of Example 1. An insulation wire having a thickness of 28μ was obtained.

The characteristics of the insulation wires prepared in Examples 1, 2, 3 and 4 are shown in Table 1.

TABLE 1

| | Example 1 | Example 2 | Example 3 | Example 4 |
|---|---|---|---|---|
| Water dispersion varnish | acryl-epoxy type varnish | epoxy type varnish | acryl-epoxy type varnish | acryl-epoxy type varnish |
| Overcoat resin | water soluble polyester varnish | water soluble polyester varnish | ester imide varnish | water soluble polyester varnish |
| Diameter of bare wire | 0.5 mm | 0.5 mm | 0.5 mm | 0.5 mm |
| Thickness of film (μ) | 24 | 26 | 25 | 28 |
| Pin holes | 0/5 mm | 0 - 1/5 m | 0 - 1/5 m | 0/5 m |
| Appearance | smooth | smooth | smooth | smooth |
| Heat shock | 1 d good | 1 d good | 1 d good | 1d good |
| Breakdown voltage (KV) (in mercury) | 5.2 | 5.4 | 5.5 | 5.7 |

As is clear from the results, the insulation wires prepared in accordance with the process of the embodiment of FIG. 3 had excellent appearance and characteristics. In accordance with the hot water or steam treatment of the invention, the insulation wires could be prepared by an electrodeposition at high wire running speed which was difficult to attain with the conventional process. Thus, the process of this invention is quite advantageous in practical operation.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for preparing an insulation wire which comprises:

dipping a wire into a water dispersion synthetic resin varnish and forming a resin layer on the wire by electrodeposition;

treating said wire having the electrodeposited resin layer in hot water or steam to comelt colloidal particles of said resin in the electrodeposited resin layer;

removing water from said resin layer;

exposing said resin layer to a vapor of a film-forming auxiliary agent to impregnate the film-forming auxiliary agent into said resin layer; and heating said resin layer to cure it.

2. The process for preparing an insulation wire according to claim 1 wherein said step of removing water comprises:

removing water from said resin layer by blowing air thereover.

3. The process for preparing an insulation wire according to claim 2 which further comprises:

preventing swinging of said wire by said air blowing thereover.

4. A process of preparing an insulation wire which comprises:

dipping a wire into a water dispersion synthetic resin varnish and forming a resin layer on the wire by electrodeposition;

treating said wire having the electrodeposited resin layer in hot water or steam to comelt colloidal particles of said resin in the electrodeposited resin layer;

removing water from said resin layer;

coating a water soluble type or organic solvent type varnish on the resin layer after said water removal step;

and heating said wire to cure the coating.

5. The process for preparing an insulation wire according to claim 4 which further comprises:

controlling the thickness of the insulation film after the step of coating a water soluble type or organic solvent type varnish on said resin layer.

* * * * *